US010357874B2

(12) United States Patent
Engvall et al.

(10) Patent No.: US 10,357,874 B2
(45) Date of Patent: Jul. 23, 2019

(54) APPARATUS AND METHOD FOR A STORAGE CONTAINER WITH INTEGRATED TABLE

(71) Applicant: IRWIN INDUSTRIAL TOOL COMPANY, Huntersville, NC (US)

(72) Inventors: David P. Engvall, Stanley, NC (US); Stephen Pennington, Kalamazoo, MI (US); Michael Reedy, Portage, MI (US); Adam Dudycha, Paw Paw, MI (US); Jose C. Santiago, Plainwell, MI (US)

(73) Assignee: Irwin Industrial Tool Company, Huntersville, NC (US)

( * ) Notice: Subject to any disclaimer, the term of this patent is extended or adjusted under 35 U.S.C. 154(b) by 153 days.

(21) Appl. No.: 15/344,121

(22) Filed: Nov. 4, 2016

(65) Prior Publication Data

US 2017/0129097 A1 May 11, 2017

Related U.S. Application Data

(60) Provisional application No. 62/252,853, filed on Nov. 9, 2015.

(51) Int. Cl.
*B25H 1/04* (2006.01)
*B25H 1/12* (2006.01)
(Continued)

(52) U.S. Cl.
CPC ..... *B25H 3/02* (2013.01); *A45C 11/20* (2013.01); *B25H 1/04* (2013.01); *B25H 1/12* (2013.01); *B65D 43/161* (2013.01); *B65D 43/163* (2013.01); *B65D 51/24* (2013.01); *F25D 3/08* (2013.01); *B65D 45/24* (2013.01);
(Continued)

(58) Field of Classification Search
CPC . B25H 3/02; B25H 1/12; B65D 51/24; B65D 43/24; B65D 43/22; B65D 43/163; B65D 43/161; B65D 2251/1008; A45C 11/20; F25D 3/08
USPC ..... 220/212, 522, 324, 326, 827–832; 206/373
See application file for complete search history.

(56) References Cited

U.S. PATENT DOCUMENTS 1,682,885 A * 9/1928 Butler ..... A47B 77/14 220/324
2,685,363 A * 8/1954 Falk ..... B25H 3/02 206/523
(Continued)

*Primary Examiner* — James N Smalley
(74) *Attorney, Agent, or Firm* — Bruce S. Shapiro

(57) ABSTRACT

A storage container can include a bottom surface and one or more sides that extend up from the bottom surface to define a storage area. The storage container can also include a lid rotatably coupled to at least one of the sides and can be moved from a closed position, preventing or limiting access to the storage area, to an open position, allowing access. The storage container can also include a work surface rotatably coupled to a bottom side of the lid. When the lid is opened, the work surface is rotated into a substantially horizontal position providing a planar top surface to work on. The storage container can also include a leg support assembly that is rotatably coupled to one or more of the side walls of the storage container and can be adjusted into a support position to provide vertical support for a portion of the work surface.

19 Claims, 7 Drawing Sheets

(51) Int. Cl.

| | |
|---|---|
| ***B25H 3/02*** | (2006.01) |
| ***F25D 3/08*** | (2006.01) |
| ***A45C 11/20*** | (2006.01) |
| ***B65D 43/16*** | (2006.01) |
| ***B65D 45/24*** | (2006.01) |
| ***B65D 51/24*** | (2006.01) |

(52) U.S. Cl.
CPC ..... *B65D 2251/1008* (2013.01); *B65D 2251/1083* (2013.01)

(56) References Cited

U.S. PATENT DOCUMENTS

| | | | | |
|---|---|---|---|---|
| 4,986,438 | A * | 1/1991 | Borst | B65D 43/0218 220/315 |
| 6,039,416 | A * | 3/2000 | Lambert | A47B 5/06 108/48 |
| 2006/0191948 | A1* | 8/2006 | Wisniewski | B65D 43/164 220/831 |
| 2010/0000893 | A1* | 1/2010 | Twig | B25H 3/023 206/373 |
| 2012/0037643 | A1* | 2/2012 | Matt | A45C 11/20 220/592.2 |
| 2012/0104013 | A1* | 5/2012 | Cowie | B25H 3/02 220/831 |

* cited by examiner

APPARATUS AND METHOD FOR A STORAGE CONTAINER WITH INTEGRATED TABLE

RELATED APPLICATIONS

This application claims priority under 35 U.S.C. § 119 to U.S. Provisional Patent Application No. 62/252,853 filed Nov. 9, 2015, and titled "Apparatus and Method for a Storage Container with Integrated Table," the entire contents of which are hereby incorporated herein by reference for all purposes.

TECHNICAL FIELD

Embodiments disclosed herein are generally related to storage containers and more particularly to apparatuses and methods for a storage container, such as a tool storage container, with integrated work surface or table.

BACKGROUND

Job boxes and other forms of tool storage containers are very useful for storing and transporting tools from one job site to another or from one location on a jobsite to another. In many cases, the tools stored within the storage container are most efficiently used in conjunction with a work surface. However, transporting both a separate work surface, such as a table, and the storage container at the same time or in separate trips can be difficult or time consuming. In addition, the stability and/or levelness of the jobsite can make it difficult to use a separate work surface even if the worker is able to get it to the jobsite.

BRIEF DESCRIPTION OF THE SEVERAL VIEWS OF THE DRAWINGS

For a more complete understanding of the present disclosure and certain features thereof, reference is now made to the following description, in conjunction with the accompanying figures briefly described as follows.

DETAILED DESCRIPTION OF THE EXEMPLARY EMBODIMENTS

Figure 1A:
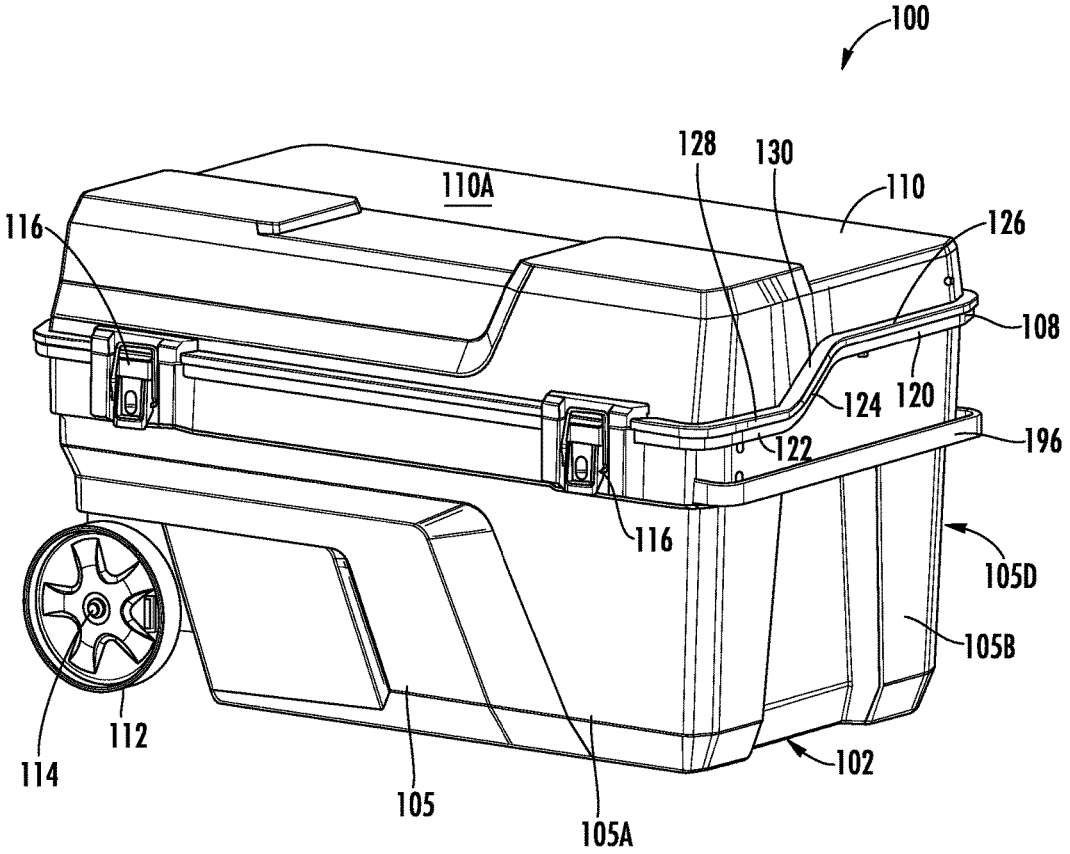
FIGS. 1A-1E present various views of a storage container, such as a tool storage container, with an integrated work surface, in accordance with one example embodiment of the disclosure.

Example embodiments of the storage container with integrated table now will be described more fully hereinafter with reference to the accompanying drawings, in which example embodiments are shown. This novel storage container with integrated table may, however, be embodied in many different forms and should not be construed as limited to the example embodiments set forth herein; rather, these embodiments are provided so that this disclosure will be thorough and complete, and will fully convey the scope of the invention to those skilled in the art. Like numbers refer to like, but not necessarily the same or identical, elements throughout.

Certain dimensions and features of the example storage containers are described herein using the term "approximately." As used herein, the term "approximately" indicates that each of the described dimensions is not a strict boundary or parameter and does not exclude functionally similar variations therefrom. Unless context or the description indicates otherwise, the use of the term "approximately" in connection with a numerical parameter indicates that the numerical parameter includes variations that, using mathematical and industrial principles accepted in the art (e.g., rounding, measurement or other systematic errors, manufacturing tolerances, etc.), would not vary the least significant digit.

In addition, certain relationships between dimensions of the storage containers and between features of the storage containers are described herein using the term "substantially." As used herein, the term "substantially" indicates that each of the described dimensions or linear descriptions is not a strict boundary or parameter and does not exclude functionally similar variations therefrom. Unless context or the description indicates otherwise, the use of the term "approximately" in connection with a numerical parameter indicates that the numerical parameter includes variations that, using mathematical and industrial principles accepted in the art (e.g., rounding, measurement or other systematic errors, manufacturing tolerances, etc.), would not vary the least significant digit.

In addition, certain relationships between dimensions of the storage containers and between features of the storage containers are described herein using the term "substantially equal". As used herein, the term "substantially equal" indicates that the equal relationship is not a strict relationship and does not exclude functionally similar variations therefrom. Unless context or the description indicates otherwise, the use of the term "substantially equal" in connection with two or more described dimensions indicates that the equal relationship between the dimensions includes variations that, using mathematical and industrial principles accepted in the art (e.g., rounding, measurement or other systematic errors, manufacturing tolerances, etc.), would not vary the least significant digit of the dimensions. As used herein, the term "substantially constant" indicates that the constant relationship is not a strict relationship and does not exclude functionally similar variations therefrom. As used herein, the term "substantially parallel" indicates that the parallel relationship is not a strict relationship and does not exclude functionally similar variations therefrom.

FIGS. 1A-1E present various views of a storage container 100, such as a tool storage container, with integrated work surface, in accordance with one example embodiment of the disclosure. Referring now to FIGS. 1A-1E, the example storage container 100 can include a bottom surface 102 and one or more side walls 105 coupled to or integrally formed with the bottom surface 102. Each side wall 105 can include a first edge disposed adjacent a corresponding edge of the bottom surface 102 and can extend vertically or substantially vertically upward from the bottom surface 102. Each side wall 105 can terminate at an upper edge 108 and/or mating surface for abutting against a corresponding bottom edge or mating surface of the top lid 110. In one example, the combination of the bottom surface 102 and one or more side walls 105 define a cavity or volume 190 for receiving and storing objects therein. In one example embodiment, the storage container 100 can include four side walls 105, a front wall 105A, a first side wall 105B, a second side wall 105C, and a rear wall 105D. In one example, these four sidewalls 105A-D are configured in the shape of a rectangle. However, any other 4-sided shape is contemplated herein, such as a square, parallelogram, trapezoid, etc. Further, while the example embodiment presents a four-sided storage container 100, in other example embodiments, the storage container can have any other number of sides walls, including, but not limited to, single-sided (such as in a circular or oval container), three-sided, five sided, etc. In one example embodiment, the bottom surface 102 and the side walls 105 can be integrally formed with one another. Alternatively, they could be formed separately and coupled together. In certain example embodiments, the bottom surface 102 and side walls 105 are made of plastic, such as high density polyethylene. However, other materials, including metals, alloys, and/or wood can additionally or alternatively be used to form the bottom surface 102 and side walls 105.

The storage container 100 can further include a top lid 110. The top lid 110 can include a top side 110A and an opposing bottom side 110B. In one example embodiment, the top side 110A can include one or more planar or substantially planar top surfaces. The top lid 110 can be removably and/or rotatably coupled to or more of the side walls 105 and may be manually adjustable from an open position to a closed position, where at least a portion of the top lid abuts or otherwise rests upon at least one or more of the side walls 105.

Figure 1B:
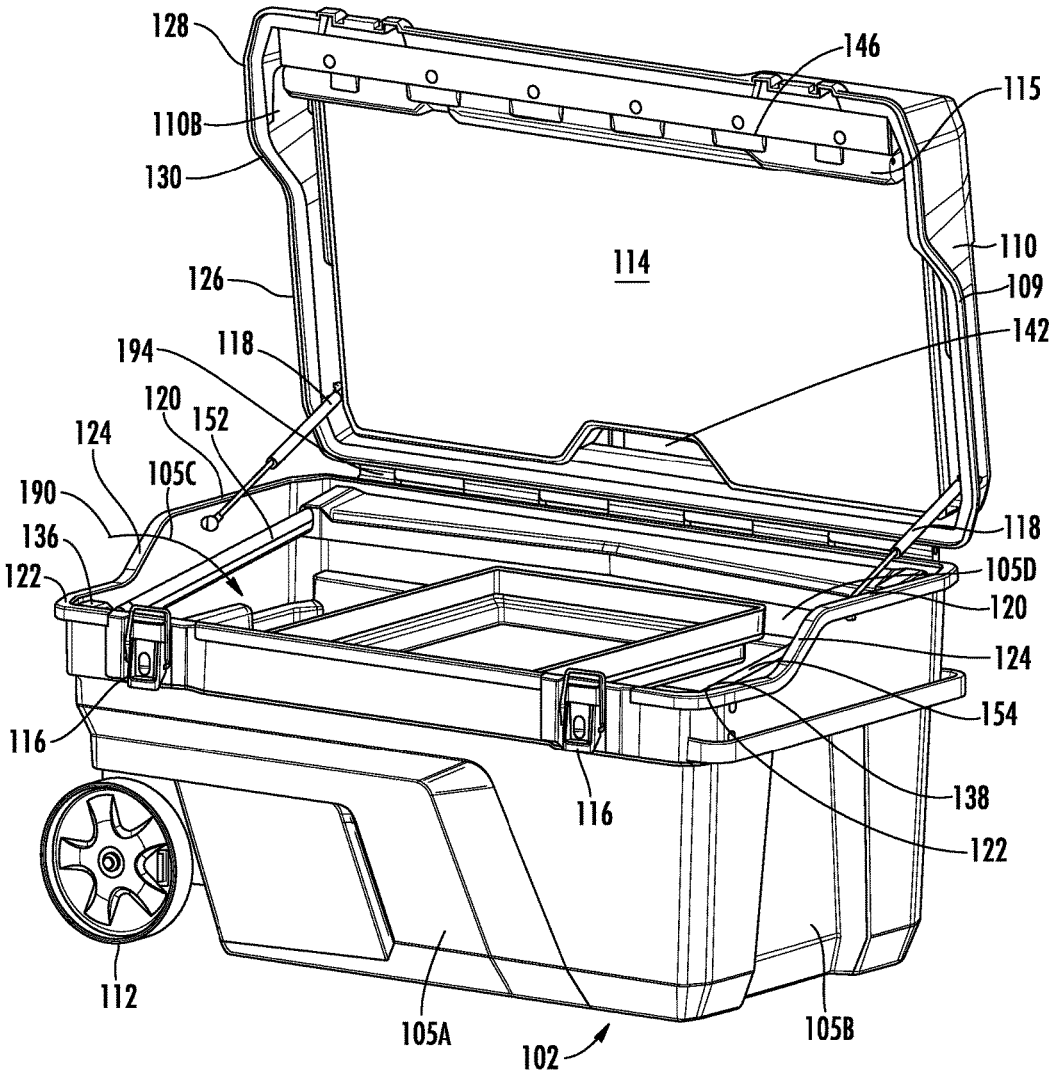

The storage container 100 can also include one or more latching mechanisms 116 disposed on one or more of the side walls 105A-D. Many different forms of latching mechanism known in the art may be used an included herein. For example, each latching mechanism 116 may include a solid lip and adjustable latch which can be mounted on an outer surface of the particular side wall 105. The adjustable solid lip section allows a user to easily lift the latch to release the top lid 110 from the respective side wall 105. The top lid 110 may include a mating latch bar or receiving recess that the latch can engage and disengage from. While the example embodiment of FIGS. 1A-B shows two latching mechanisms 116 disposed along the front wall 105A, in alternate embodiments, fewer or greater than two latching mechanisms may be provided on a particular side 105 and any one or more of the first side wall 105B, second side wall 105C, and rear wall 105D may also include one or more latching mechanisms 116 for removably coupling the top lid 110 to the side wall 105.

In addition, the top lid 110 may be rotatably coupled to one or more of the side walls 105. For example, as shown in FIG. 1B, the top lid 110 can be rotatably coupled to the rear wall 105D. In one example, the top lid 110 is rotatably coupled to the rear wall 105D by way of one or more hinges 194. For example, the hinge 194 may be coupled along one side to the rear wall 105D and along the other side to the top lid 110. Alternatively, each of the rear wall 105D and top lid 110 can include one or more knuckles that matingly engage one another (e.g., are positioned next to one another in a lid knuckle, wall knuckle, lid knuckle, wall knuckle, etc arrangement) to form an elongated passageway through the adjacently positioned knuckles that can receive one or more pins that define the rotational axis of the hinge 194 and/or the top lid 110. However, any other known devices for rotatably coupling two members may be substituted for the example hinge 194. The top lid 110 can be configured to rotate from a first or closed position (such as shown in FIG. 1A), where the top lid 110 covers or substantially covers the cavity 190 defined by the sides 105 into the storage container 100 and is disposed orthogonal or substantially orthogonal to one or more of the sides 105, to a second or open position (such as shown in FIGS. 1B-E), where the top lid 110 is disposed in a less than vertical position. In one example embodiment, the top lid 110 in the second or open position can have a maximum opening position such that it positions the top side 110A of the top lid 110 at an angle (a) short of being vertical. In one example embodiment, the angle (a) can be anywhere within the range of substantially 5 degrees to substantially 25 degrees. Having a maximum opening position for the top lid 110 that is short of vertical, as discussed above, allows for the front edge of the table 114, when in the use position, to extend to or further out than the front wall 105A of the storage container 100. In an alternate embodiment, the top lid 110 in the second or open position can be vertical or substantially vertical and the top side 110A of the top lid 110 can be parallel or substantially parallel to the back side 105D.

The storage container may also include one or more rotation limiters 118 that limit the rotation of the top lid 110 with respect to the back side 105D. For example, the rotation limiter 118 may have a first end and a distal second end. The first end of the rotation limiter 118 can be coupled to one of the side walls 105, such as the second side wall 105C and the second end of the rotation limiter 118 can be coupled to the top lid 110, such as along the bottom side 110B of the top lid 110. In one example, the rotation limiter 118 is a gas spring pneumatic cylinder. In this example embodiment, two rotation limiters 118 may be provided, one coupled to the first side wall 105B and the top lid 110 and the other coupled to the second side wall 105C and top lid 110. In another example embodiment, the rotation limiter 118 can be a spring, wire, string, coupled along one end to one of the walls 105 and coupled along an opposing end to the top lid 110 to limit rotation of the top lid to the open position as described above. In another alternative embodiment, the rotation limiter can be a different device that is integral with or included in the hinge 194. In certain example embodiments, each rotation limiter 118 can be spring biased or pneumatically biased to hold the top lid 110 in the open position. By providing rotation limiters 118 that bias the top lid 110 into the open position, the user can open the top lid 110 and then begin to rotate the table 114 into the user configuration without still having to maintain contact with the top lid 110 to prevent it from rotating back into the closed position.

The example storage container 100 can also include one or more wheel assemblies disposed along or adjacent to the bottom surface 102 of the storage container 100. In one example embodiment, each wheel assembly can include one or more wheels 112 and an axle 113 about which the wheels 112 rotate. The bottom surface 102 or side wall 105 can also include an axle mount (not shown) for receiving and retaining the axle 113 to the body of the storage container 100. The axle mount can be an opening or passageway in the bottom surface 102 or side wall 105 for retaining the axle 113. While the wheel 112 is only shown along the intersection of the front wall 105A and the second side wall 105C of the container 100, another wheel 112 can also be positioned along the intersection of the rear wall 105D and the second sidewall 105C. Further, while only one wheel assembly is shown in the example embodiment, in alternative embodiments additional wheel assemblies can be included, such as along the first side wall 105B. The storage container 100 can also include one or more handles 196. Each handle 196 can be integrally formed with one or more sides 105 of the container in one example embodiment. In another example embodiment, each handle 196 can be coupled to and extend from one or more sides 105 of the container 100. For example, the container 100 can include a rotatable and/or extendable pull handle disposed along the first side wall 105B or another side wall 105 of the container 100.

In certain example embodiments, the top lid 110 can further include a bottom edge 109 extending along the outer perimeter of the bottom side 110A of the top lid 110. In certain example embodiments, the bottom edge 109 can be made up of multiple sections positioned at differing vertical heights with respect to the bottom surface 102 when the top lid 110 is in the closed position. For example, the bottom edge 109 can include a first section 126 that extends from one side of the top lid 110 around the back side of the top lid 110 and to the opposing side of the top lid 110. This first section 126 can be flat or substantially horizontal when the top lid 110 is in the closed position. The bottom edge 109 can also include a second section 128 that extends from the one side of the top lid, around the front side of the top lid 110 and to the opposing side of the top lid 110. The second section 128 of the bottom edge 109 of the top lid 110 can also be substantially flat and/or substantially horizontal when the top lid 110 is in the closed position. Further, the second section 128 can be positioned at a vertical height that is lower and closer to the bottom surface 102 than the first section 126 when the top lid 110 is in the closed position. The bottom edge 109 can also include transition sections 130 that vertically transitions the bottom edge 109 of the top lid 110 from the first section 126 to the second section 128 at an angle to the horizontal when the top lid 110 is in the closed position. This sectioning of the bottom edge 109 provides a top lid 110 that has a greater depth along the front side of the top lid 110 as compared to the back side of the top lid. This greater depth along the front side of the top lid can provide for a greater space to rotate the table disposed within a cavity of the top lid 110 defined by the bottom edge 109.

The side walls 105 can further include the upper edge 108 extending along the top edge of each of the side walls 105. In certain example embodiments, like the bottom edge 109, the upper edge 108 can be made up of multiple sections positioned at differing vertical heights with respect to the bottom surface 102. For example, the upper edge 108 can include a first section 120 that extends from the first side wall 105B along the top of the rear wall 105D and to the opposing second side wall 105C. This first section 120 can be substantially flat and substantially horizontal. The upper edge 108 can also include a second section 122 that extends from the first side wall 105B, along the top of the front wall 105A and to the opposing second side wall 105C. The second section 122 of the upper edge 108 can also be substantially flat and/or substantially horizontal. Further, the second section 122 can be positioned at a vertical height that is lower and closer to the bottom surface 102 than the first section 120. The upper edge 108 can also include transition sections 124 that each vertically transitions the upper edge 108 of the side walls 105 from the first section 120 to the second section 122 at an angle to the horizontal. This sectioning of the upper edge 108 generally corresponds with the sectioning of the bottom edge of the top lid 110 as at least a portion of the upper edge 108 is configured to abut and/or engage the bottom edge 109 of the top lid 110 when the top lid 110 is in the closed position.

With further reference to FIGS. 1B-1E, the bottom side 110B of the top lid 110 can further include a cavity 142. In certain example embodiments, the cavity 142 can be an opening or depression in the bottom side 110B of the top lid 110 that creates a void or volume. In one example, disposed within the cavity 142 is a work surface or table 114. In an alternative embodiment, the work surface or table 114 may be disposed along the bottom side 110B without the cavity 142.

The work surface or table 114 (hereinafter referred to simply as a "work surface") can be rotatably or removably coupled to the top lid 110. For example, the work surface 114 can be rotatably coupled to either to the bottom side 110B or within the cavity 142 of the top lid 110 by way of a hinge member 146, such as a hinge bracket, or any other rotating mechanism known to those or ordinary skill in the art. In one example embodiment, the hinge member 146 can be rotatably coupled to one end of the work surface 114 and coupled to either the bottom side 110B or within the cavity 142 of the top lid 110. The example hinge member 146 can include one or more knuckles that matingly engage one or more knuckles 205 (FIG. 2) of the work surface 114 (e.g., are positioned next to one another in a hinge member knuckle, work surface knuckle, hinge member knuckle, work surface knuckle, etc arrangement) to form an elongated passageway through the adjacently positioned knuckles that can receive one or more pins that define the rotational axis of the work surface 114. In other example embodiments, other known devices for rotatably coupling two members may be substituted for the example hinge member 146.

Figure 1C:
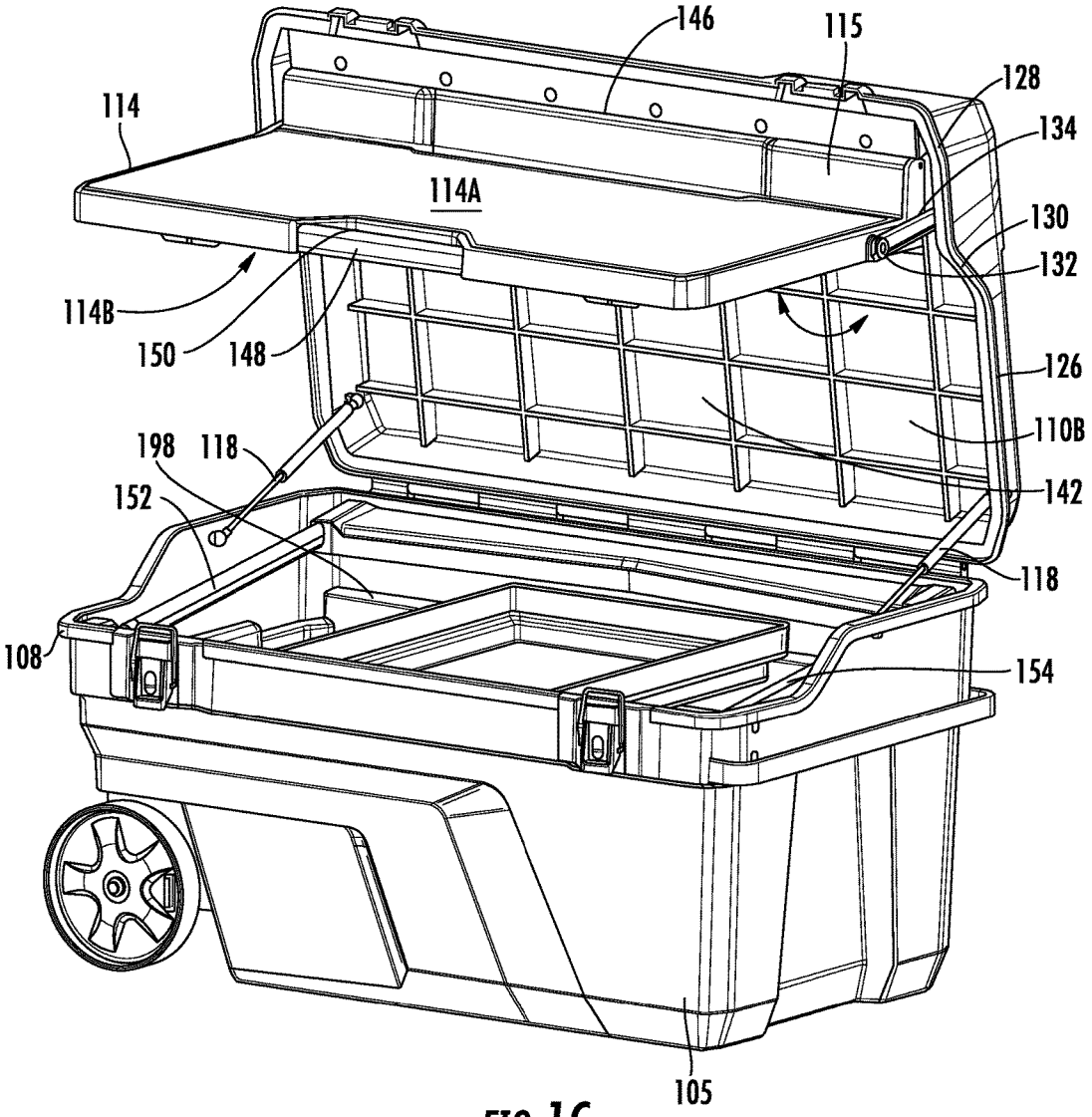
Figure 1D:
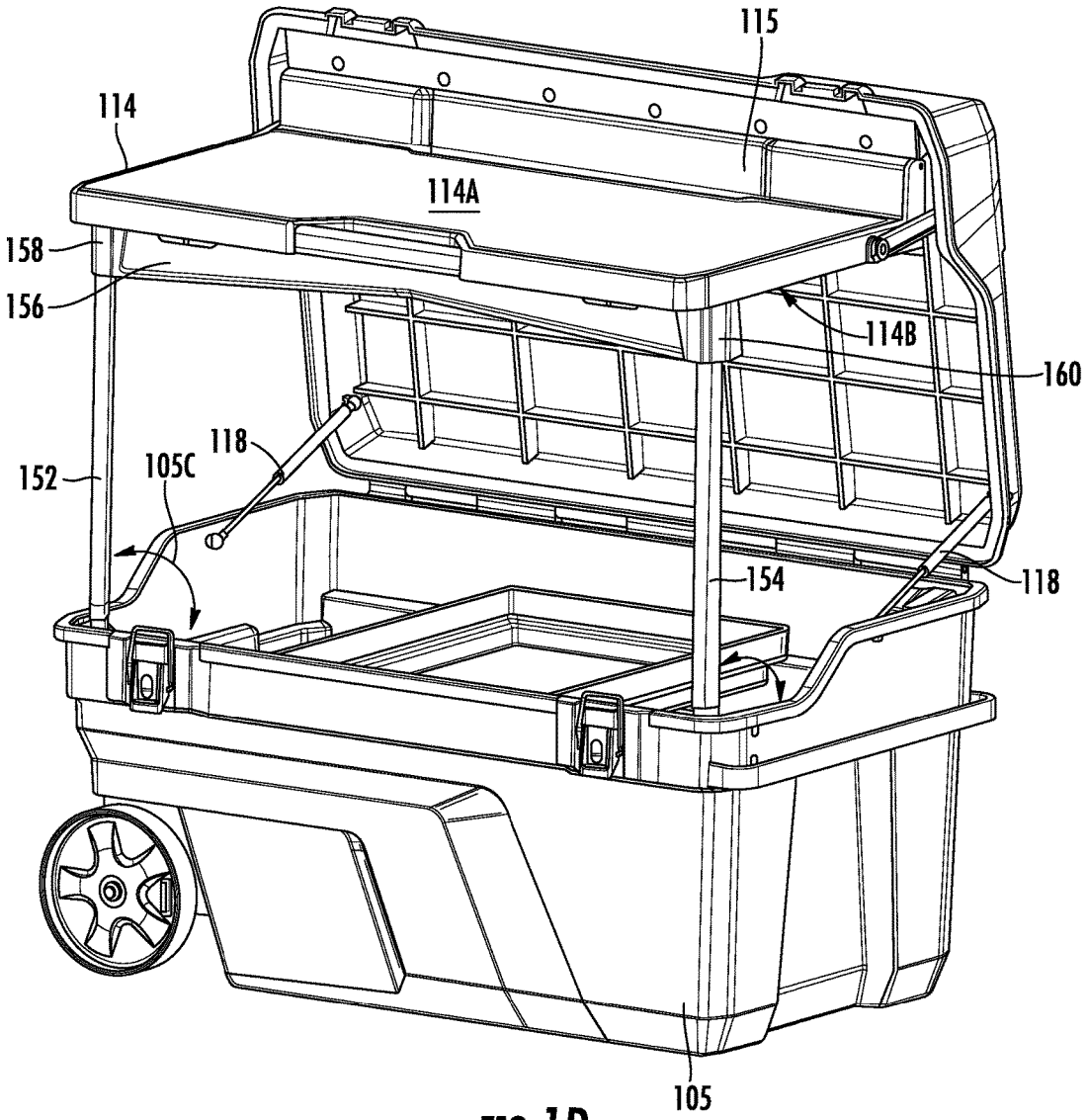
Figure 1E:
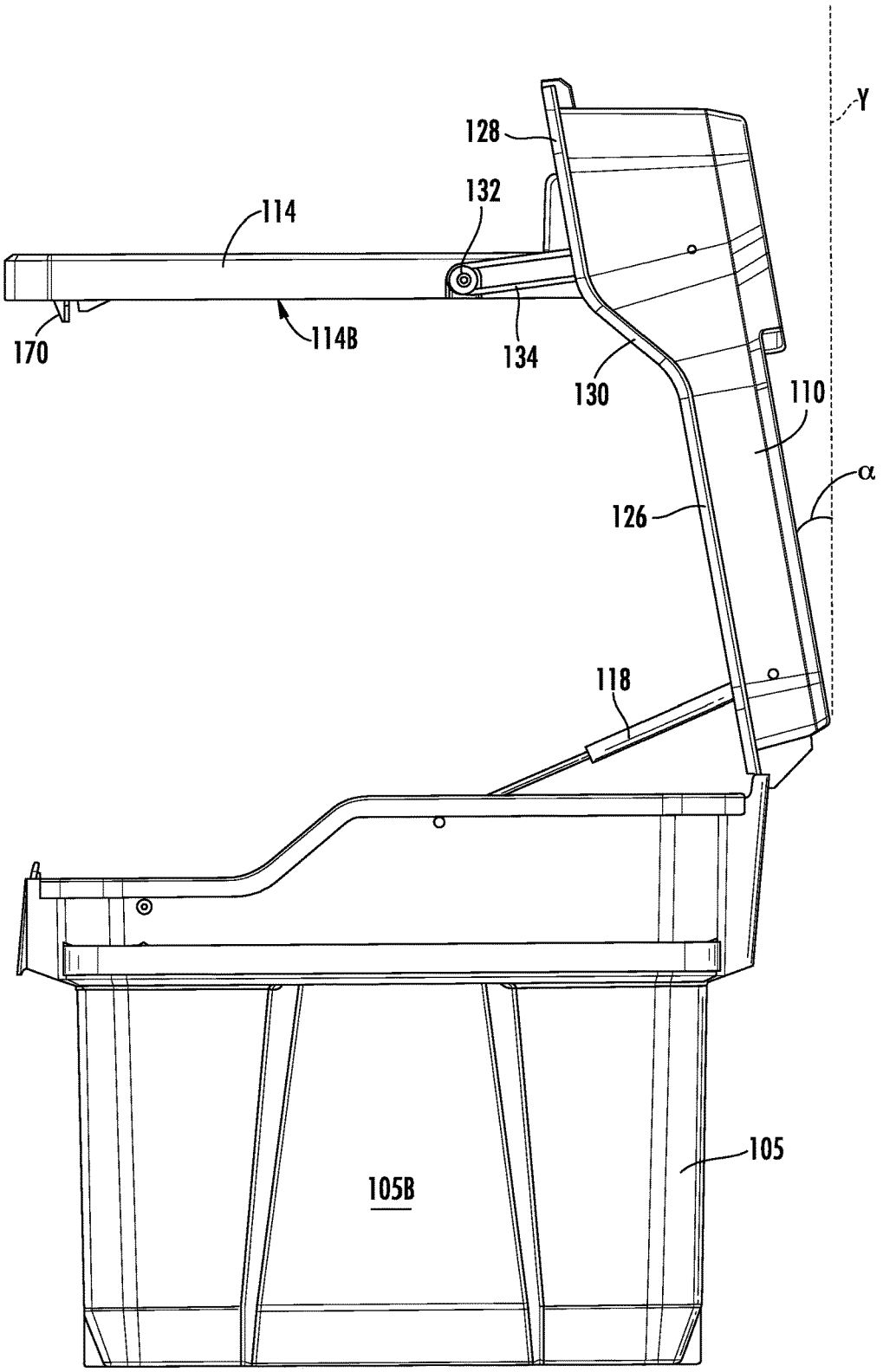

In this example, the work surface 114 can be rotated from a first or stored position (as shown in FIG. 1B) to a second or use position (as shown in FIGS. 1C-E). In one example, the rotation of the work surface 114 from the stored position to the use position can be anywhere in the range of substantially 80 degrees to substantially 120 degrees and more preferably anywhere in the range of substantially 100 degrees to substantially 120 degrees and more preferably substantially 110 degrees.

In one example, the work surface 114 includes one horizontal member (when viewed in the use position) having a planar or substantially planar top surface 114A (when viewed in the use position) and an opposing bottom surface 114B. For example, the work surface 114 can include a single member that rotates out from the stored position with the bottom surface 114 B abutting the bottom side 110B of the top lid 110 to the use position. Alternatively, in other example embodiments, the work surface 114 can include two or more members rotatably coupled to one another by way of one or more hinges (not shown), and can each be rotated from a stored position to a use position to overall adjust the work surface from a stored position to a use position. The work surface 114 can have a rectangular or substantially rectangular shape or any other geometric or non-geometric shape as desired.

Figure 2:
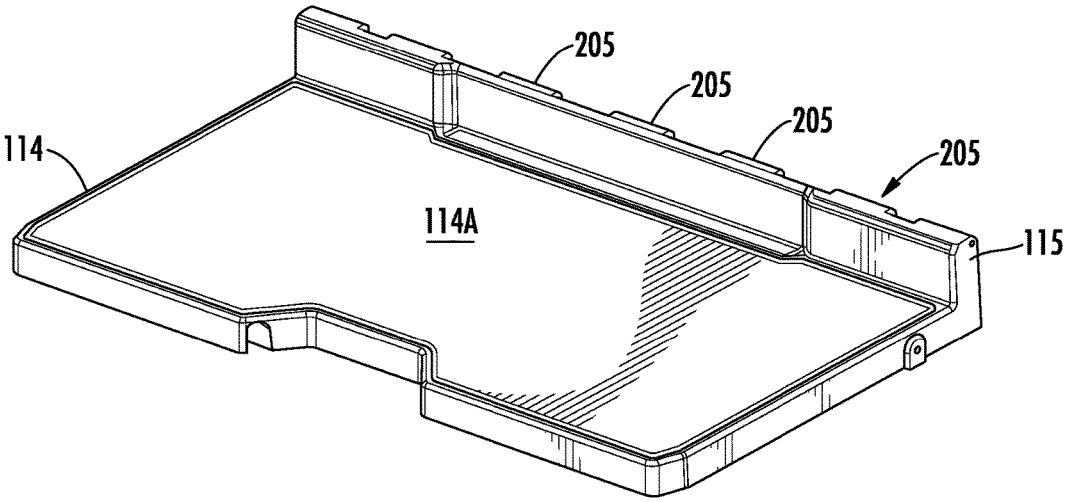
FIG. 2 is a perspective view of an integrated work surface, or table, for use with the tool storage container, in accordance with one example embodiment of the disclosure.

As best shown in FIG. 2, in certain example embodiments, the work surface 114 can further include a hinge attachment member 115 disposed along and extending along a back edge of the work surface 114. In one example embodiment, the hinge attachment member 115 has a bottom end that is substantially coplanar with the bottom surface 114B of the work surface 114 and extends therefrom up to and above the top surface 114A of the work surface 114 in a perpendicular or substantially perpendicular direction to the planar top surface 114A of the work surface 114 and can extend along all or substantially all of a rear edge of the work surface 114. The example hinge attachment member can include one or more knuckles 205 that matingly engage the one or more knuckles (FIG. 1B) of the hinge member 146

(e.g., are positioned next to one another in a hinge member knuckle, work surface knuckle 205, hinge member knuckle, work surface knuckle 205, etc arrangement) to form an elongated passageway through the adjacently positioned knuckles that can receive one or more pins that define the rotational axis of the work surface 114.

In another example embodiment, the work surface 114 is removably coupled to the top lid 110. In this example, embodiment, the top lid, either along the bottom side 110B or within the cavity 142, can include one or more retaining members for slidably receiving at least a portion of a side edge of the work surface 114. In this example, the work surface 114 can be removed from the top lid 110 and positioned horizontally. At least a portion of the back edge of the work surface 114 nearest the retaining members can be slid into the retaining members (which, for example, can be two planar members spaced vertically a width apart that is equal to or greater than the thickness of the work surface 114) to removably hold the work surface 114 in place with respect to the top lid 110.

In certain example embodiments, the work surface 114 can also include a handle 148. The handle 148 can be disposed along the front edge of the work surface 114 between the top surface 114A and the bottom surface 114B in certain example embodiments. In one example, the front edge of the work surface 114 can be recessed along a portion of the front edge between the first end of the handle 148 and the second end of the handle 148 such that an opening 150 is created between a substantial portion of the handle 148 and the front edge of the work surface 114 to allow a user to place a portion of their hand in that opening 150 when gripping the handle 148 and moving the work surface 114 to the use or stored position.

In certain example embodiments, the work surface 114 can also include a rotation limiter (e.g., 132, 134) that limits rotation of the work surface 114 into the use position such that the top side 114A of the work surface 114 is horizontal or substantially horizontal. In one example embodiment, the rotation limiter include a pin member 132 coupled to a side edge of the work surface 114. The rotation limiter can also include a slotted slide 134 rotatably coupled to the top lid 110. The pin member 312 can be configured to be inserted through the slotted slide 134 and slide along the slot in the slotted slide 134. When the pin member 132 reaches the distal end (opposite the end of the slot closest to the top lid 110) of the slot in the slotted slide 134, the work surface 114 can be prevented from further rotation from the stored position into the use position. While FIGS. 1B-1E show a single rotation limiter for the work surface 114, the opposing edge of the work surface can include a second rotation limiter. Further, while the rotation limiter has been described as including a pin and slot configuration, this is for example purposes only. In other example embodiments, the rotation limiter for the work surface 114 can alternatively include a wire, string, spring, a gas spring pneumatic cylinder, a strap (e.g., a plastic flexible strap), a slide with a slot, or other forms of mechanisms for limiting the rotation of one member with respect to another member.

In certain example embodiments, the work surface 114 can also include one or more locking members 170, as shown in FIG. 1E. Each example locking member 170 can extend down from the bottom side 114B of the work surface 114. In one example, the work surface 114 can include two locking members, each disposed at corresponding points along the bottom side 114B of the work surface 114 where support legs will be configured to engage the bottom side 114B of the work surface 114. Each example locking member 170 can include a stop member to prevent further rotation of the top end of the support leg. Each locking member 170 can also include a hook or slot to help hold the corresponding support leg in place along the bottom side 114B of the work surface 114 while in the use position. While only one form of locking member 170 is shown, other types of locking members may be substituted and can include, for example, a pring-loaded lug or barb or any other device for removably coupling one member to another.

The storage container 100 can further include at least one leg support assembly. The leg support assembly can be rotatably coupled directly or indirectly to one or more of the side walls 105 and/or the bottom surface 102 of the container 100 and can be adjustable from a stored position, as shown in FIG. 1B, to a support position, as shown in FIG. 1D, wherein the leg support assembly provides vertical support to the work surface 114. In one example, the leg support assembly can include a first leg member 152 rotatably coupled directly or indirectly to one of the side walls 105 or the bottom surface 102. The first leg member 152 can include a first end and a distal second end. In one example, the first leg member is rotatably coupled near the first end to one of the front wall 105A, the second side wall 105C. or the rear wall 105D. The first leg member 152 can be an elongated member having a longitudinal axis and can be rotatable about a horizontal or substantially horizontal axis from a stored position, in which the longitudinal axis of the first leg member 152 is horizontal or substantially horizontal, to a support position, in which the longitudinal axis of the first leg member 152 is vertical or substantially vertical. The distal second end of the first leg member 152 can include a flat or substantially flat end surface that defines a plane that is perpendicular or substantially perpendicular to the longitudinal axis of the first leg member 152 and provides a resting support for the bottom side 114A of the work surface 114. The distal second end of the first leg member 152 can also include an opening and/or pin for receiving and engaging the corresponding locking member 170.

The leg support assembly can also include a second leg member 154 rotatably coupled directly or indirectly to one of the side walls 105 or the bottom surface 102. The second leg member 154 can include a first end and a distal second end. In one example, the second leg member 154 is rotatably coupled near the first end to one of the front wall 105A, the first side wall 105B, or the rear wall 105D. The second leg member 154 can be an elongated member having a longitudinal axis and can be rotatable about a horizontal or substantially horizontal axis from a stored position, in which the longitudinal axis of the second leg member 154 is horizontal or substantially horizontal, to a support position, in which the longitudinal axis of the second leg member 154 is vertical or substantially vertical. The distal second end of the second leg member 154 can include a flat or substantially flat end surface that defines a plane that is perpendicular or substantially perpendicular to the longitudinal axis of the second leg member 154 and provides a resting support for the bottom side 114A of the work surface 114. The distal second end of the second leg member 154 can also include an opening and/or pin for receiving and engaging the corresponding locking member 170.

The leg support assembly can also include a bracing member 156 that has a first end 158 coupled to the first leg member 152 and a distal second end 160 coupled to the second leg member 154. The bracing member 156 can be an elongated member that extends from at least the first leg member 152 to the second leg member 154 and provides support for each of the first leg member 152 and second leg member 154. The bracing member can have a longitudinal axis that is parallel to the axis of rotation of the leg support assembly. In one example embodiment, each of the first end 158 and distal second end 160 of the bracing member 156 can include a cavity or other mounting mechanism for receiving a portion of the corresponding distal second end of the respective first leg member 152 and second leg member 154 therein to fixedly couple or removably couple the bracing member 156 to each of the first leg member 152 and second leg member 154. Each of the first end 158 and the distal second end 160 of the bracing member 156 can also include a flat or substantially flat end surface that defines a plane that is perpendicular or substantially perpendicular to the longitudinal axis of the corresponding first leg member 152 and second leg member 154 and provides a resting support for the bottom side 114A of the work surface 114. Each of the first end 158 and the distal second end 160 of the bracing member 156 can also include an opening and/or pin for receiving and engaging the corresponding locking member 170 when the leg support assembly is rotated into the support position. The container 100 can also include a ledge or extension 198 that extends horizontally along the rear wall 105D and into the cavity 190. The ledge 198 can provide support for the leg support assembly when the leg support assembly is in the stored position. For example at least a portion of the bracing member 156 can rest upon a top surface of the ledge 198 when the leg support assembly is rotated into the stored position.

Figure 3:
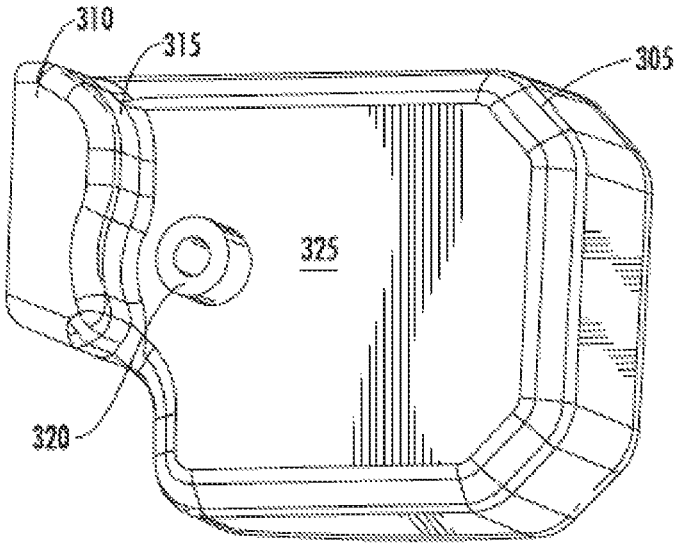
FIG. 3 is a perspective view of a leg strut assembly to facilitate rotatably coupling leg support members to the storage container, in accordance with one example embodiment of the disclosure.

FIG. 3 is a perspective view of a pivot block 136, 138 to facilitate rotatably coupling leg support members to the storage container 100, in accordance with one example embodiment of the disclosure. The first pivot block 136 can be coupled to the inner portion of the second side wall 105C in certain example embodiments. Alternatively, the first pivot block 136 can be coupled to the front wall 105A or the rear wall 105D. Similarly, in certain example embodiments, the second pivot block 138 can be coupled to the inner portion of the first side wall 105B. Alternatively, the second pivot block 138 can be coupled to the inner portion of the front wall 105A or the rear wall 105D. While the example embodiment describes attaching each pivot block 136, 138 to a wall 105 of the storage container 100, in another example embodiment, each pivot block 136, 138 can be integrally formed with the corresponding wall 105 of the storage container 100.

Each pivot block 136, 138 can include a main body 305 that extends out from the inner surface of the corresponding wall 105 of the storage container 100. The main body 305 can include a flat or substantially flat inner surface 325 that an outer side of a corresponding leg member 152, 154 can slide along. Each pivot block 136, 138 can also include a rotation hub 320 for providing an axis of rotation for the corresponding leg member 152, 154 rotatably attached thereto. In one example embodiment, the rotation hub 320 extends out from the flat inner surface 325 of the pivot block 136, 138. Alternatively, the rotation hub 320 can be an aperture disposed along and into the flat inner surface 325 and configured to receive an axle or pin for rotatably coupling the rotation hub 320 to the corresponding leg member 152, 154. In certain examples, the rotation hub 320 can have a round outer diameter and a round inner diameter that is less than the round outer diameter. The round inner diameter can define an opening or entry into a cavity for receiving an axle or pin therein.

Each pivot block 136, 138 can also include a means for stopping rotation 310 of the corresponding leg member 152, 154. In one example, the means for stopping rotation 310 can include a raised surface that extends out from the flat inner surface 325 of the pivot block 136, 138. The raised surface can include a stop surface 315 that extends perpendicular to or substantially perpendicular to the flat inner surface 325 and is configured to contact a portion 415, 420 of the corresponding leg member 152, 154 near the first end of the leg member 152, 154 to stop rotation of the leg member 152, 154 when each leg member 152, 154 is moved into the support position. Alternatively, other means for stopping rotation of the corresponding leg member can be used, including but not limited to a keyed axle and/or hub, a wire, string, spring, a gas spring pneumatic cylinder, a strap (e.g., a plastic flexible strap), a slide with a slot, or other forms of mechanisms for limiting the rotation of one member with respect to another member.

Figure 4:
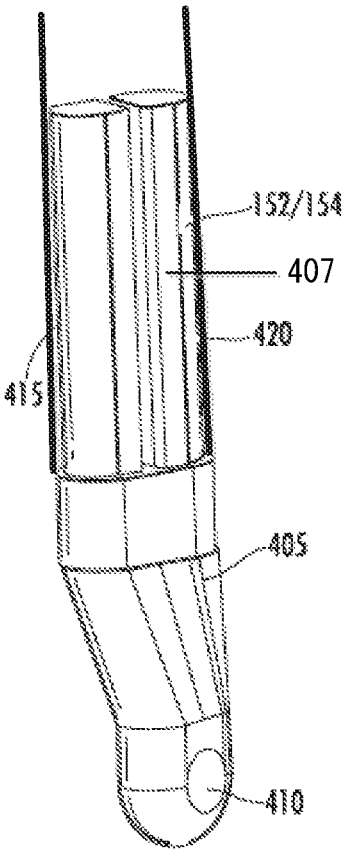
FIG. 4 is a perspective view of a leg support strut connector to facilitate rotatably coupling leg supports to the storage container, in accordance with one example embodiment of the disclosure.

As shown in FIG. 4, each leg member 152, 154 of the leg support assembly can further include a leg strut member 405 to facilitate rotatably coupling each leg member 152, 154 to the storage container 100, in accordance with one example embodiment of the disclosure. In one example embodiment, each leg strut member 405 can be removably coupled to the corresponding leg member 152, 154. For example, each leg strut member 405 can include a leg insert member 407 configured to be slidably received into a hollow portion of an end of the corresponding leg member 152, 154. In one example, the leg insert member 407 can have a friction fit with an internal surface of the hollow portion of the corresponding leg member 152, 154. In an alternative embodiment, the each leg strut member 405 can be integrally formed with its corresponding leg member 152, 154. Each leg strut member 405 can also include an opening 410 that provides a passageway through the leg strut member 405. The opening 410 can be configured to receive an axle or pin that defines an axis of rotation about which the leg strut member 405, and the corresponding leg member 152, 154 attached thereto, rotates about. In addition or in the alternative, the opening 410 can have a diameter that is substantially the same or a little bit greater than the outer diameter of the rotation hub 320. In this example embodiment, all or at least a portion of the rotation hub 320 can be received in the opening 410 and the leg strut member 405 can be removably coupled to the corresponding pivot block 136, 138. In this example, the rotation hub 320 can define an axis of rotation about which the leg strut member 405 and the corresponding leg member 152, 154 attached thereto rotates about. A bolt (e.g., carriage bolt), screw, or other attachment means can removably couple the leg strut member 405 to the corresponding pivot block 136, 138 to prevent the leg strut member 405 from pulling away from the pivot block 136, 138 while allowing the leg strut member 405 to rotate about the axis of rotation defined by the rotation hub 320.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could,"

"might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

What is claimed is:

1. A storage container comprising:

a bottom surface having a perimeter edge;

at least one side wall extending vertically up from the perimeter edge, wherein the bottom surface and the at least one side wall define a volume within the storage container;

a lid rotatably coupled to one of the at least one side wall and configured to rotate from a closed position to an open position;

a table including a work support surface, said table rotatably coupled to the top lid and configured to rotate from a storage position to a use position; and a leg support assembly rotatably coupled to the at least one side wall and configured to rotate from a stored position to a support position, wherein in the support position, the leg support assembly provides a vertical support to at least a portion of the table.

2. The storage container of claim 1, wherein the at least one side wall comprises a rear wall, an opposing front wall, a first side wall, and an opposing second side wall, and wherein the leg support assembly comprises:

a first leg member comprising a first end rotatably coupled to the first side wall and a distal second end;

a second leg member comprising a third end rotatably coupled to the second side wall and a distal fourth end.

3. The storage container of claim 2, wherein the leg support assembly further comprises a bracing member comprising a first end coupled to the second end of the first leg member and a distal second end coupled to the fourth end of the second leg member.

4. The storage container of claim 1, wherein the table comprises:

a fixed side rotatably coupled to the top lid;

an opposing free side; wherein, said work support surface includes a planar top surface disposed between the fixed side and the free side.

5. The storage container of claim 4, wherein in the support position, the leg support assembly contacts a bottom side of the work support surface adjacent to the free side of the work support surface.

6. The storage container of claim 4, wherein the fixed side further comprises a hinge attachment member comprising a first end coupled to the fixed side and a distal second side extending up from the planar top surface of the work support surface, wherein the second side of the hinge attachment member is rotatably coupled to the top lid.

7. The storage container of claim 1, further comprising a first means for limiting rotation, wherein the first means for limiting rotation limits a rotation of the lid into the open position an angle (a) degrees short of a vertical, 90 degree position.

8. The storage container of claim 7, wherein the first means for limiting rotation comprises one of a pneumatic cylinder, a spring, a wire, or a string.

9. The storage container of claim 7, wherein the angle (a) is between substantially 5 degrees and substantially 25 degrees.

10. The storage container of claim 7, wherein the first means for limiting rotation biases the lid into the open position.

11. The storage container of claim 1, further comprising means for limiting rotation of the table, the means for limiting rotation having a first portion coupled to a bottom side of the lid and a distal second end coupled to the table.

12. A method for accessing a work surface of a storage container comprising:

providing the storage container comprising:

a bottom surface having a perimeter edge;

a plurality of side walls extending vertically up from the perimeter edge, wherein the bottom surface and the plurality of side walls define a volume within the storage container;

a lid rotatably coupled to one of the plurality of side walls and rotatable from a closed position to an open position;

the work surface rotatably coupled to the top lid and rotatable from a storage position to a use position; and a leg support assembly rotatably coupled to at least one of the plurality of side walls and rotatable from a stored position to a support position;

rotating the lid from the closed position to the open position;

rotating the work surface from the storage position to the use position; and rotating the leg support assembly from the stored position to the support position, wherein at least a portion of the leg support assembly vertically supports at least a portion of the work surface.

13. The method of claim 12, wherein in open position, the lid is disposed at an angle ($\alpha$) short of a 90 degree vertical position, wherein the method further comprises:

providing a means for limiting rotation of the lid, comprising a first end coupled to one of the plurality of side walls and a distal second end coupled to the lid; and limiting the rotation of the lid into the open position to the angle ($\alpha$) short of the 90 degree vertical position.

14. The method of claim 12, wherein the angle ($\alpha$) is between substantially 5 degrees and substantially 25 degrees.

15. The method of claim 12, further comprising:

providing a means for limiting rotation of the work surface comprising a first end coupled to the lid and a distal second end coupled to the work surface; and limiting rotation of the work surface into the use position wherein a planar top surface of the work surface is disposed at a second angle in the use position that is in the range of substantially 95 to substantially 120 degrees from a position of the planar top surface in the storage position.

16. The method of claim 12, further comprising biasing the lid into the open position.

17. A storage container comprising:

a bottom surface having a perimeter edge;

a plurality of side walls comprising a front wall, opposing rear wall, first side wall and opposing second side wall, each of the plurality of side walls extending vertically up from the perimeter edge, wherein the bottom surface and the plurality of side walls define a volume within the storage container;

a lid rotatably coupled to the rear wall and configured to rotate from a closed position to an open position, wherein in the closed position, the lid prevents access to the volume within the storage container;

a work surface rotatably coupled to the top lid and configured to rotate from a storage position to a use position; and a leg support assembly rotatably coupled to the first side wall and the second side wall and configured to rotate from a stored position to a support position, wherein in the support position, the leg support assembly provides a vertical support to at least a portion of the work surface.

18. The storage container of claim 17, wherein the work surface comprises a fixed end, an opposing free end, a planar top surface, and an opposing bottom surface, each of the top surface and bottom surface disposed between the fixed end and the free end, wherein the fixed end is rotatably coupled to the lid and wherein at least a portion of bottom surface adjacent the free end contacts at least a portion of the leg support assembly in the support position.

19. The storage container of claim 17, wherein the leg support assembly comprises:

a first elongated leg member comprising a first end rotatably coupled to the first side wall and a distal second end;

a second elongated leg member comprising a third end rotatably coupled to the second side wall and a distal fourth end; and a bracing member comprising a first end coupled to the second end of the first leg member and a distal second end coupled to the fourth end of the second leg member, wherein the bracing member comprises a top surface extending between the first end and the second end and wherein at least a portion of the top surface of the bracing member contacts at least a portion of the work surface in the support position.

* * * * *